US005822903A

United States Patent [19]

Davis, Sr.

[11] Patent Number: 5,822,903

[45] Date of Patent: Oct. 20, 1998

[54] EXTERNALLY ADJUSTABLE SLIDE TRIGGER ASSEMBLIES FOR HANDGUNS

[75] Inventor: James Jefrey Davis, Sr., Trion, Ga.

[73] Assignee: Craig T. Luttes, Sparks, Nev.

[21] Appl. No.: 908,883

[22] Filed: Aug. 8, 1997

[51] Int. Cl.[6] ..... F41A 19/00

[52] U.S. Cl. ..... 42/69.01; 42/70.07

[58] Field of Search ..... 42/69.01, 70.07, 42/69.03, 65, 7; 89/194, 195, 196

[56] References Cited

U.S. PATENT DOCUMENTS 4,691,461 9/1987 Behlert ..... 42/69.01

4,744,165 5/1988 Garofalo ..... 42/69.01

4,955,155 9/1990 Jones ..... 42/69.01

*Primary Examiner*—Charles Jordan

*Assistant Examiner*—Meena Chelliah

[57] ABSTRACT

An externally adjustable slide trigger assembly which is a drop-in replacement for existing conventional slide triggers. No drilling/tapping or other handgun modifications are required. The variable adjustment range provided allows the handgun owner to change trigger-pull characteristics from a stock trigger-pull weight to a low competition trigger-pull weight in the field. Trigger slack is completely eliminated at or near competition trigger-pull weights.

11 Claims, 9 Drawing Sheets

EXTERNALLY ADJUSTABLE SLIDE TRIGGER ASSEMBLIES FOR HANDGUNS

BACKGROUND—FIELD OF INVENTION

This invention relates to handguns, specifically to externally adjustable slide trigger assemblies for handguns.

BACKGROUND—DESCRIPTION OF PRIOR ART

In conventional handguns, a trigger is provided which has a related linkage mechanism which together act to control and actuate a spring-loaded firing pin. The force required to be applied to the trigger to actuate the firing pin is called the trigger-pull weight.

Most handguns are delivered from the place of manufacture with trigger-pull weights which are fixed and considered by many shooters to be too heavy for accurate shooting. The need for a light trigger-pull in some shooting situations has been known for a long time and has generally been addressed in one of two ways. The first way has been to take the handgun to a gunsmith who would work on the firearm to reduce the trigger-pull to some extent. This is generally a costly endeavor in both gun down time and expenditure of funds. The handgun owner is left with a fixed-weight trigger-pull which is somewhat lighter than before the handgun went to the gunsmith. The second way to reduce trigger-pull has been to purchase a handgun with a fixed lightweight trigger-pull. The selection of handguns in this category is limited and they tend to be expensive. Neither of these two general approaches allows the shooter to revert back to a heavier trigger-pull weight without resorting to a gunsmiths' help or buying another handgun.

The need for a handgun where the user can variably adjust the trigger-pull weight in the field to meet the needs of different shooters and/or different shooting situations has only recently been addressed. Specifically, in U.S. Pat. No. 4,691,461 to Behlert, a double trigger arrangement is utilized which provides variable contact points between a front pivot trigger and the face of a cooperating non-pivoting slide trigger such that the mechanical advantage between the first and second triggers can be changed to provide variable trigger-pull weights. The contact points and associated trigger-pull weights can be adjusted by the user in the field with simple hand tools. However, this trigger mechanism has a distinct disadvantage in that the handgun frame must be drilled and tapped to accept the addition of the pivot trigger. This disadvantage was noted and was the object of a subsequent U.S. Pat. No. 4,955,155 to Jones which did away with the drilling and tapping of the frame for the pivoting trigger by mounting the pivoting trigger to the slide trigger itself. However, this invention has two distinct disadvantages in that the frame must be drilled and tapped to accept a set screw and the trigger mechanism is not adjustable.

SUMMARY OF THE INVENTION

The present invention provides an externally adjustable trigger assembly by way of an adjustable trigger link. In handguns with a slide trigger, a novel slide trigger mechanism is shown which allows the trigger-pull weight to be variably adjusted in the field with simple hand tools and without requiring modification the firearm in anyway other than a direct drop-in replacement of the existing trigger assembly with the present trigger assembly invention. The trigger has rear mounted flanges which limit forward trigger movement. The adjusting mechanism utilizes an adjusting plug which is mounted in the trigger. Inserted into this adjusting plug from the rear of the trigger is a rod which is affixed to and an integral part of the trigger link. The adjusting plug is rotated within its trigger mounting with a simple hand tool. As the plug rotates, the rod travels forward or backward which causes the trigger link to move closer to or further from the firing mechanism. If the link is moved towards the firing mechanism, play in the trigger linkage to firing mechanism interface is removed as the trigger link moves closer to the point of tripping the firing mechanism. This causes the trigger-pull weights to variably decrease to low levels. The combined effect provides a slide trigger assembly with excellent trigger-pull characteristics for accurate firing.

Still further objects and advantages will become apparent from a consideration of the ensuing description and drawings.

REFERENCE NUMERALS IN DRAWINGS

Figure 1:
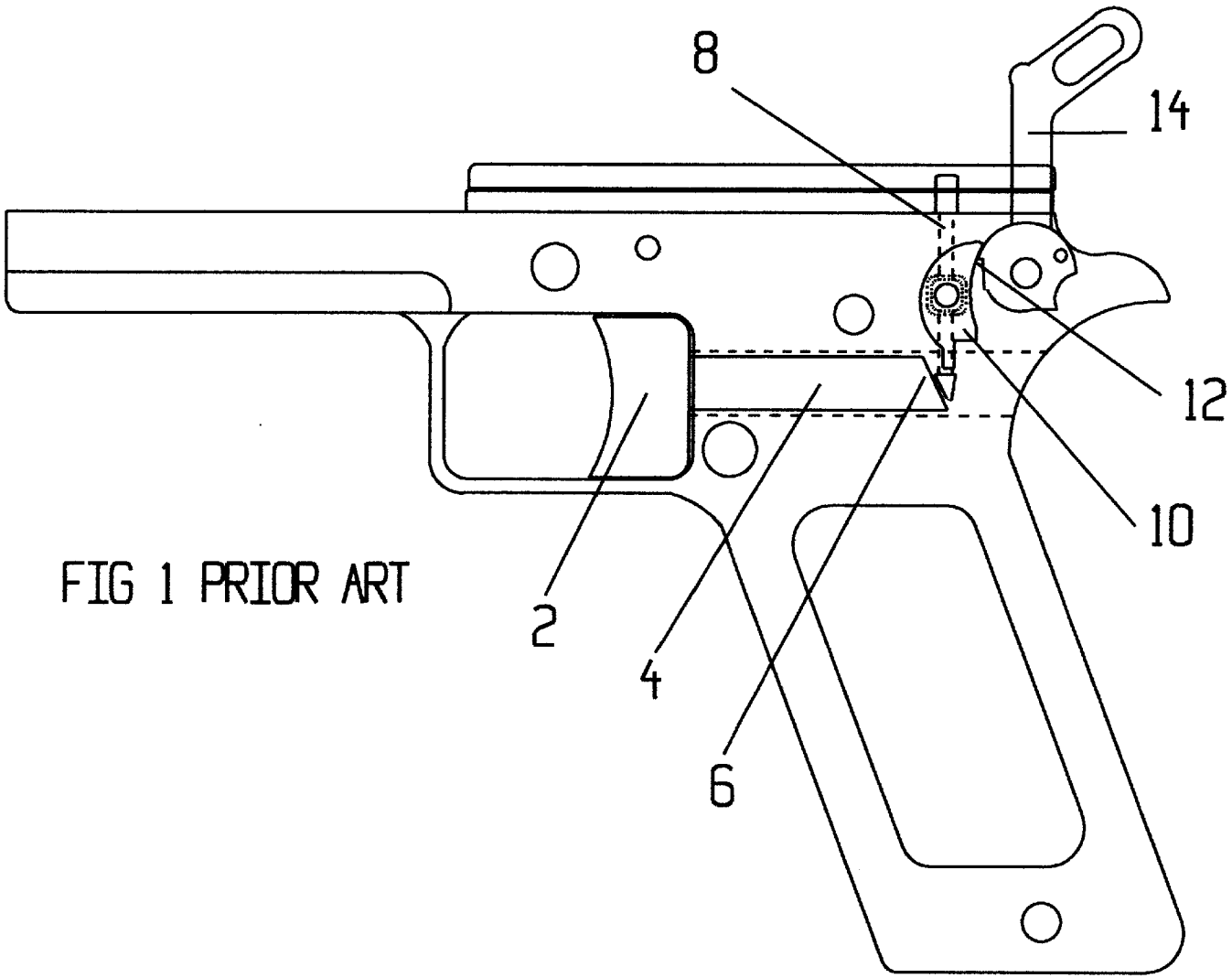
FIG 1 PRIOR ART
FIG. 1 shows a sectional view of a prior art handgun with a conventional slide trigger assembly.

2 conventional slide trigger
4 conventional trigger actuation stirrup
6 rear surface actuation stirrup
8 sear disconnector
10 sear
12 hammer full cock notch
14 hammer
16 trigger stop flanges
18 partially threaded trigger adjusting hole
20 externally threaded adjusting plug with internal threaded hole
22 allen head socket
24 threaded pin
26 stirrup side rails
28 internal stirrup frame rails
30 reserved
32 side accessible externally threaded adjusting plug with internal threaded hole

34 side accessible rotating mechanism
36 externally threaded adjusting plug with internal smooth hole
38 smooth pin

DESCRIPTION OF THE PREFERRED EMBODIMENT

A prior art handgun is illustrated—FIG. 1, the handgun having a conventional slide trigger assembly comprised of a conventional slide trigger 2 and a conventional trigger actuation stirrup 4. Operation of the conventional slide trigger assembly is accomplished by pulling trigger 2 rearward which causes trigger actuation stirrup 4 to travel rearward as the two are directly joined together. A rear surface actuation stirrup 6 presses against a sear disconnector 8 which causes a sear 10 to disengage from a hammer full cock notch 12 which causes a hammer 14 to fall and the handgun to fire. No provision is made for this conventional slide trigger assembly to be externally adjustable for varying trigger-pull weight.

Figure 2A:
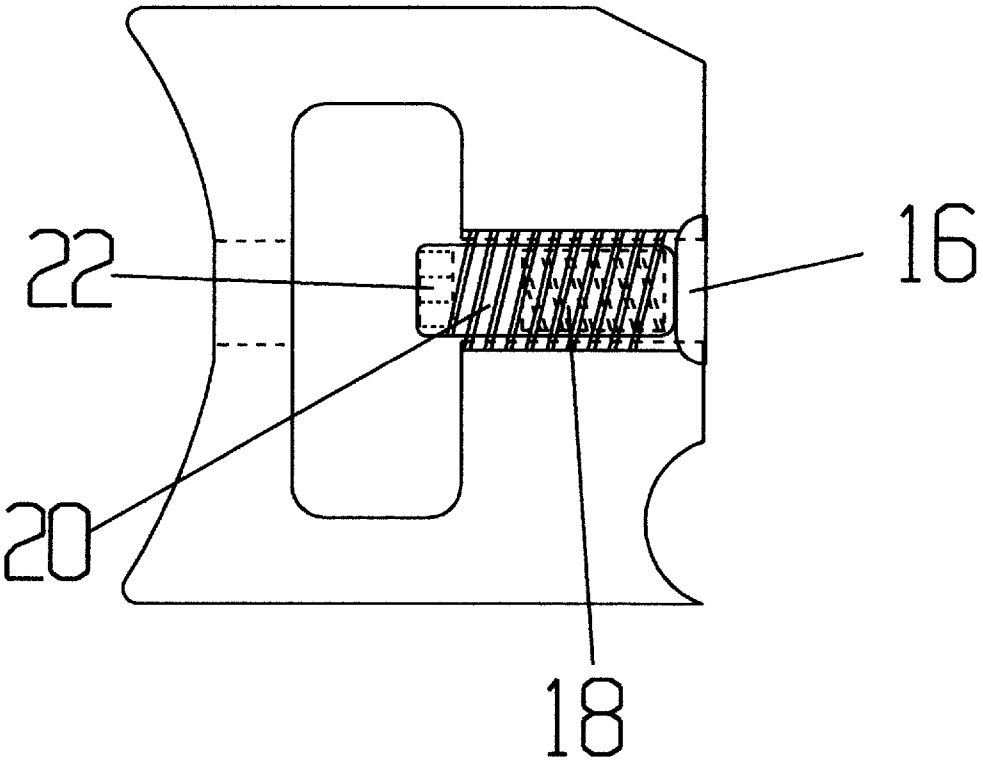
FIG. 2A shows a side perspective view of an adjustable slide trigger subassembly of the first embodiment.
Figure 2B:
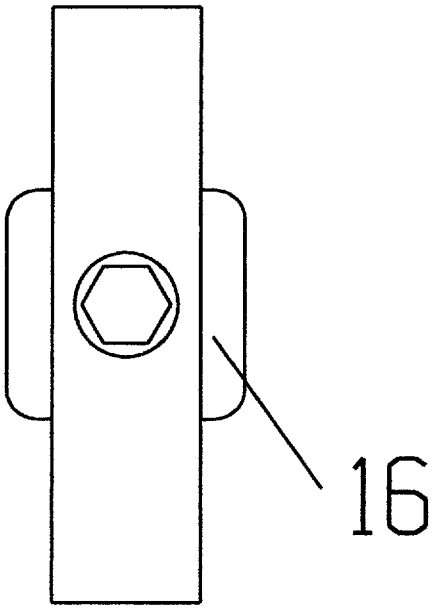
FIG. 2B shows a frontal perspective view of the adjustable slide trigger subassembly of the first embodiment.
Figure 3:
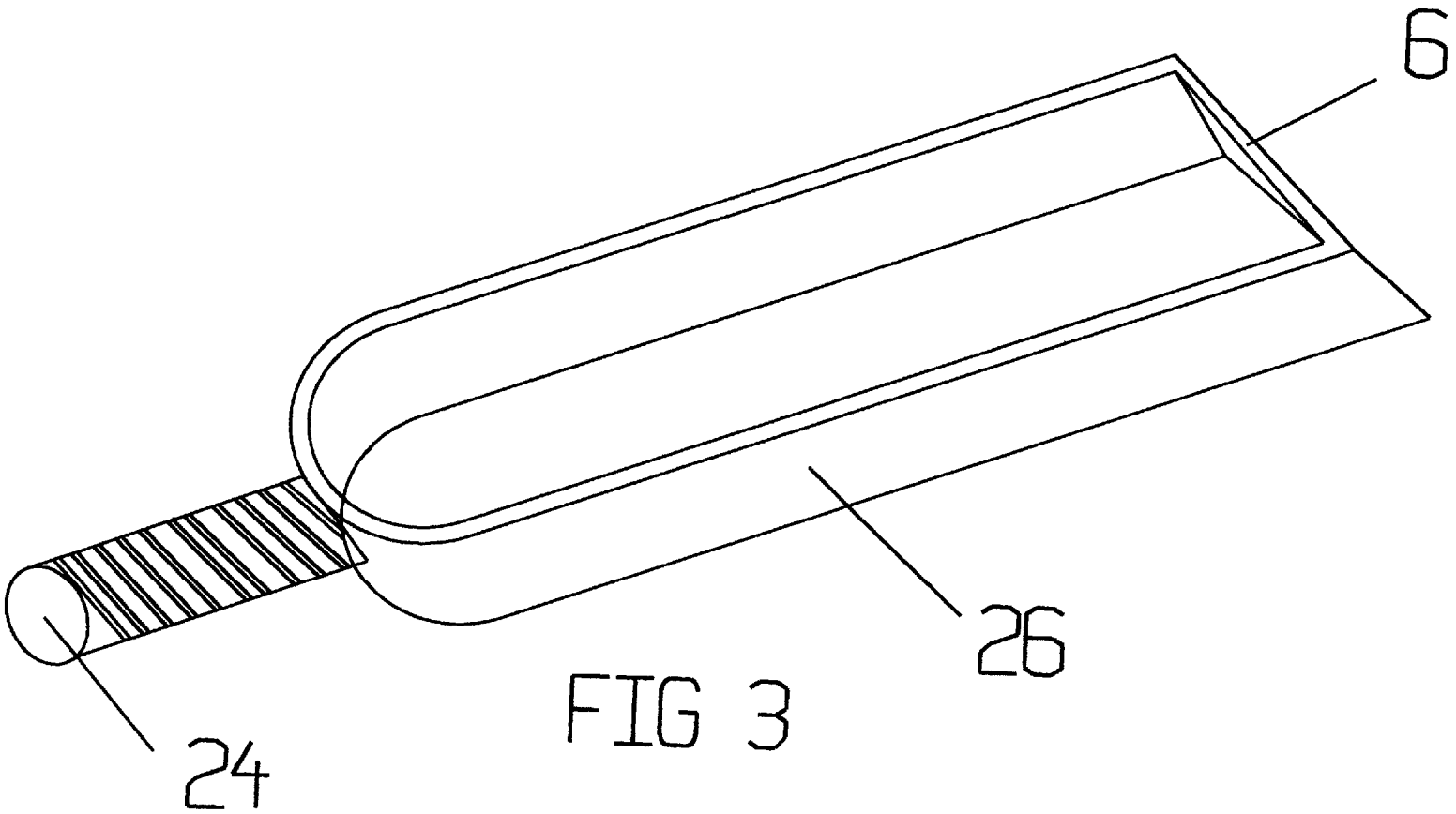
FIG. 3 shows a perspective view of the adjustable trigger actuation stirrup subassembly of the first and second embodiments.
Figure 4:
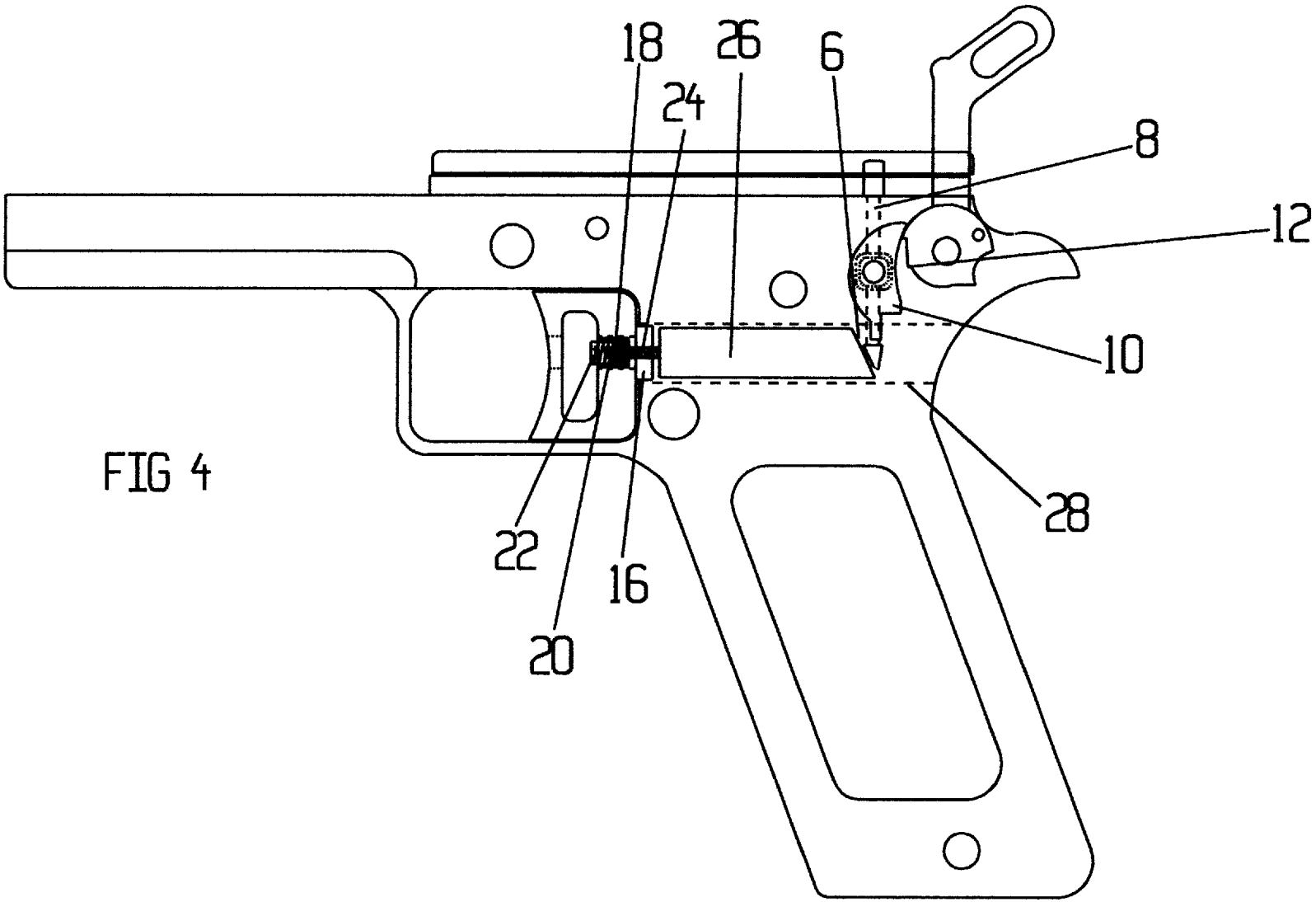
FIG. 4 shows a sectional view of a handgun with the first embodiments installed.

The preferred embodiment of the externally adjustable trigger assembly) handguns with slide trigger is illustrated—FIG. 2A, FIG. 2B, FIG. 3, and FIG. 4. FIG. 2A shows a perspective view of an adjustable slide trigger subassembly which includes a pair of trigger stop flanges 16, a partially threaded trigger adjusting hole 18, and a externally threaded adjusting plug with internal threaded hole 20. FIG. 2B shows a frontal view of the adjustable slide trigger subassembly to show a better view of trigger stop flanges 16. FIG. 3 shows a perspective view of an adjustable trigger actuation stirrup subassembly which includes a threaded pin 24, a pair of stirrup side rails 26 and a rear surface actuation stirrup 6. Operation of this adjustable slide trigger assembly is as follows. Plug 20 is threaded into hole 18 via the front of the trigger subassembly. Threaded pin 24 is threaded into the internal threaded hole of plug 20 via the back of the trigger subassembly. This adjustable trigger assembly is installed in the handgun in the same manner and in place of the conventional slide trigger as shown in FIG. 4. Trigger stop flanges 16 limit forward trigger travel in the handgun frame by fitting within and butting up against the end of a pair of internal stirrup frame rails 28 as shown in FIG. 4. An allen wrench is inserted into allen head socket 22 in the front of the trigger and turned in a clockwise direction. This causes plug 20 to move toward the rear of the trigger as it travels in hole 18. As plug 20 moves rearward, threaded pin 24 which is threaded into plug 20, moves rearward. As threaded pin 24 is rigidly affixed to stirrup side rails 26, this rearward motion causes rear surface actuation stirrup 6 to move closer to and ultimately to begin to engage sear disconnector 8. The rearward motion of rear surface actuation stirrup 6 is limited by partially threaded trigger adjusting hole 18 which plug 20 travels in. Plug 20 will bottom out in hole 18 at a point prior to rear surface actuation stirrup 6 moving sear disconnector 8 to the point where sear 10 is disengaged from a hammer full cock notch 12. Trigger slack is eliminated and trigger-pull is the lightest at this point. When plug 20 is rotated in a counterclockwise direction via allen head socket 22, rear surface actuation stirrup 6 moves away from sear disconnector 8. Trigger slack is re-introduced and trigger-pull increases as plug 20 is rotated in a counterclockwise direction, reaching maximum trigger-pull when stirrup side rails 26 are brought into contact with trigger stop flanges 16 which rest in internal stirrup frame rails 28. One of the advantages of this embodiment over conventional slide triggers is the ability to remove the slack commonly encountered in conventional triggers when pulled. Another advantage of this embodiment is to allow the handgun user to variably adjust the trigger-pull weight required to fire the handgun. As rear surface actuation stirrup 6 is adjusted closer to sear disconnector 8, the trigger-pull weight required to fire the handgun is reduced. The trigger-pull weight is increased as rear surface actuation stirrup 6 is adjusted away from sear disconnector 8. A significant advantage over the externally adjustable trigger in U.S. Pat. No. 4,691,461 to Behlert is that no drilling and tapping of the frame is required. This embodiment is a drop-in replacement requiring no other handgun modifications. Another significant advantage of this embodiment over the Behlert design is the elimination of trigger-pull slack. The Behlert design does not remove this undesirable trigger-pull characteristic.

Figure 5A:
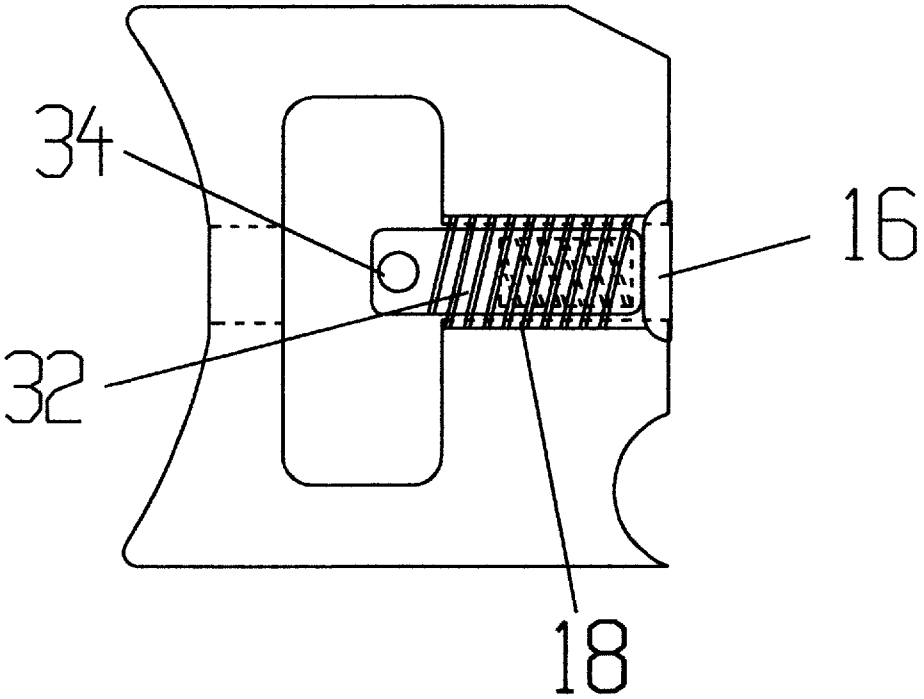
FIG. 5A shows a side perspective view of an adjustable slide trigger subassembly of the second embodiment.
Figure 5B:
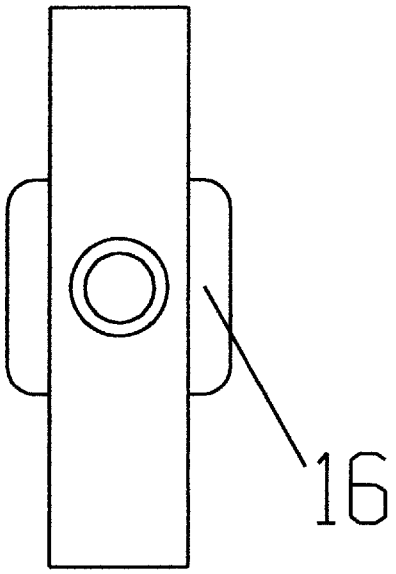
FIG. 5B shows a frontal perspective view of an adjustable slide trigger subassembly of the second embodiment.
Figure 6:
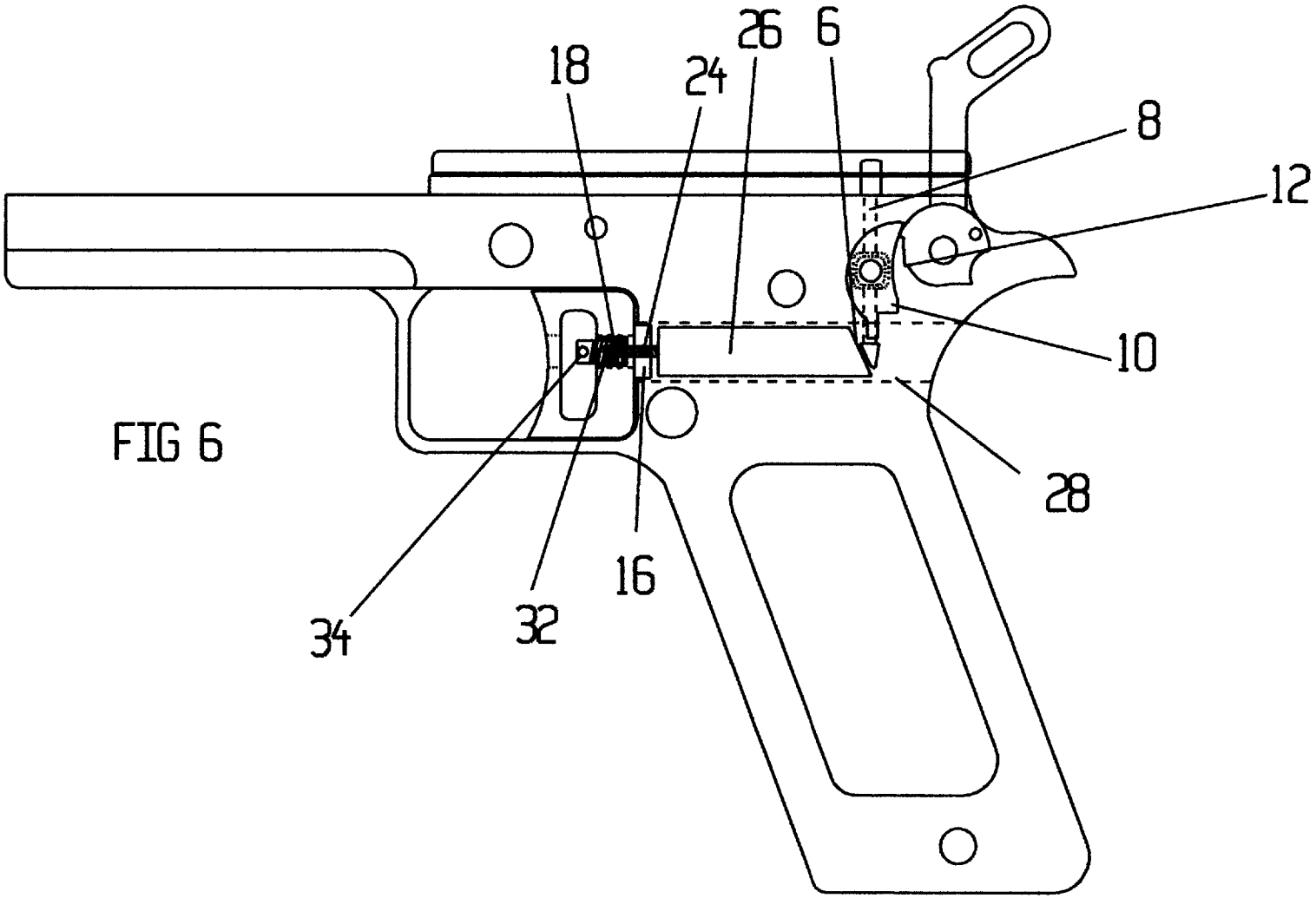
FIG. 6 shows a sectional view of a handgun with the second embodiment installed.

A second embodiment of the externally adjustable trigger assembly for handguns with slide trigger is illustrated in FIG. 3, FIG. 5A, FIG. 5B, and FIG. 6. FIG. 5A shows a perspective view of an adjustable slide trigger subassembly which includes a pair of trigger stop flanges 16, a partially threaded trigger adjusting hole 18, a side accessible externally threaded adjusting plug with internal threaded hole 32 and a side accessible rotating mechanism 34. FIG. 5B shows a frontal view of the adjustable slide trigger subassembly to show a better view of trigger stop flanges 16. FIG. 3 shows a perspective view of an adjustable trigger actuation stirrup subassembly which included a threaded pin 24, a pair of stirrup side rails 26 and a rear surface actuation stirrup 6. Operation of this adjustable slide trigger assembly is as follows. Plug 32 is threaded into hole 18, access provided via the front of the trigger. Threaded pin 24 is threaded into the internal threaded hole of plug 32 via the back of the trigger subassembly. This adjustable trigger assembly is installed in the handgun in the same manner and in place of the conventional slide trigger as shown in FIG. 6. Trigger stop flanges 16 limit forward trigger travel by fitting within and butting up against the end of a pair of internal stirrup frame rails 28 as shown in FIG. 6. A thin rod is inserted into one of the adjusting holes of a side accessible rotating mechanism 34 and mechanism 34 is turned in a clockwise direction. As rotating mechanism 34 is an integral part of plug 32, this rotation causes plug 32 to move toward the rear of the trigger as it travels in hole 18. As threaded pin 24 is rigidly affixed to stirrup side rails 26, this rearward motion causes rear surface of actuation stirrup 6 to move closer to and ultimately to begin to engage sear disconnector 8. The rearward motion of rear surface actuation stirrup 6 is limited by partially threaded trigger adjusting hole 18 which plug 32 travels in. Plug 32 will bottom out in hole 18 at a point prior to rear surface actuation stirrup 6 moving sear disconnector 8 to the point where sear 10 is disengaged from a hammer full cock notch 12. Trigger slack is eliminated and trigger-pull is the lightest at this point. When plug 32 is rotated in a counterclockwise direction via side accessible rotating mechanism 34, rear surface actuation stirrup 6 moves away from sear disconnector 8. Trigger slack is reintroduced and trigger-pull increases as plug 32 is rotated in a counterclockwise direction via mechanism 34, reaching maximum trigger-pull when stirrup side rails 26 are brought into contact with trigger stop flanges 16 which rest in internal stirrup frame rails 28. The advantages of this embodiment over conventional slide triggers and the Behlert adjustable trigger are identical to those described in the first embodiment above.

Figure 7A:
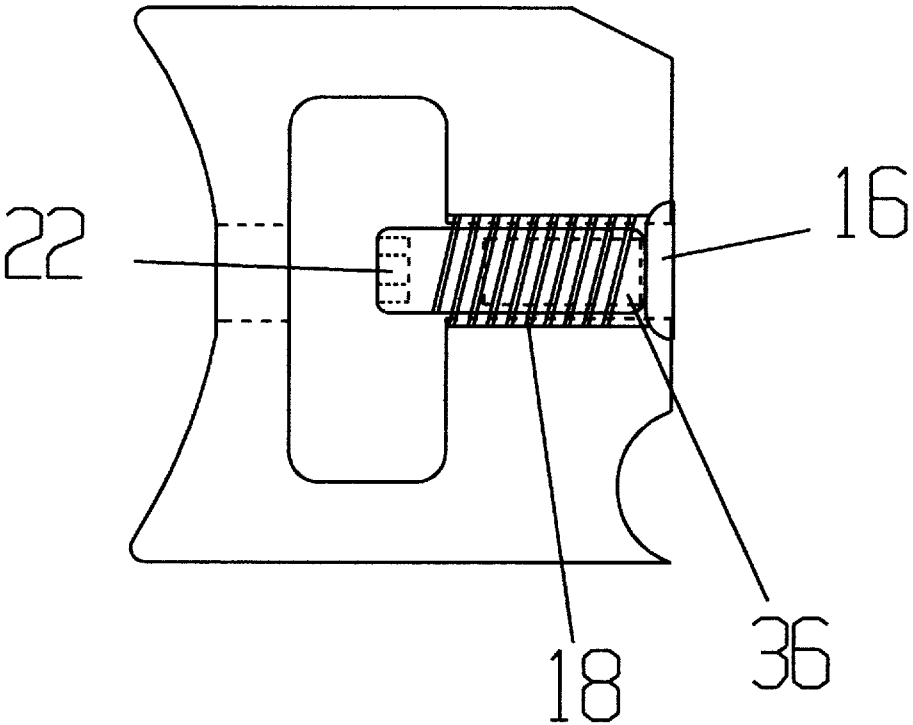
FIG. 7A shows a side perspective view of an adjustable slide trigger subassembly of the third embodiment.
Figure 7B:
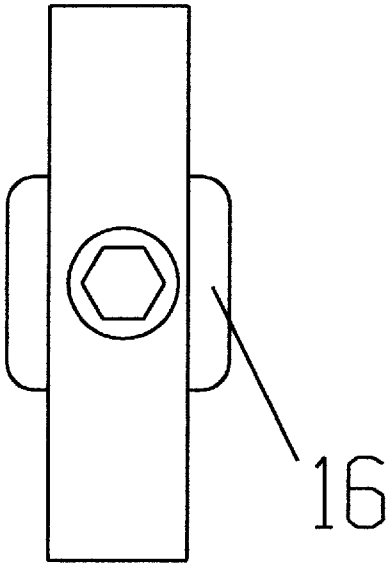
FIG. 7B shows a frontal perspective view of an adjustable slide trigger subassembly of the third embodiment.
Figure 8:
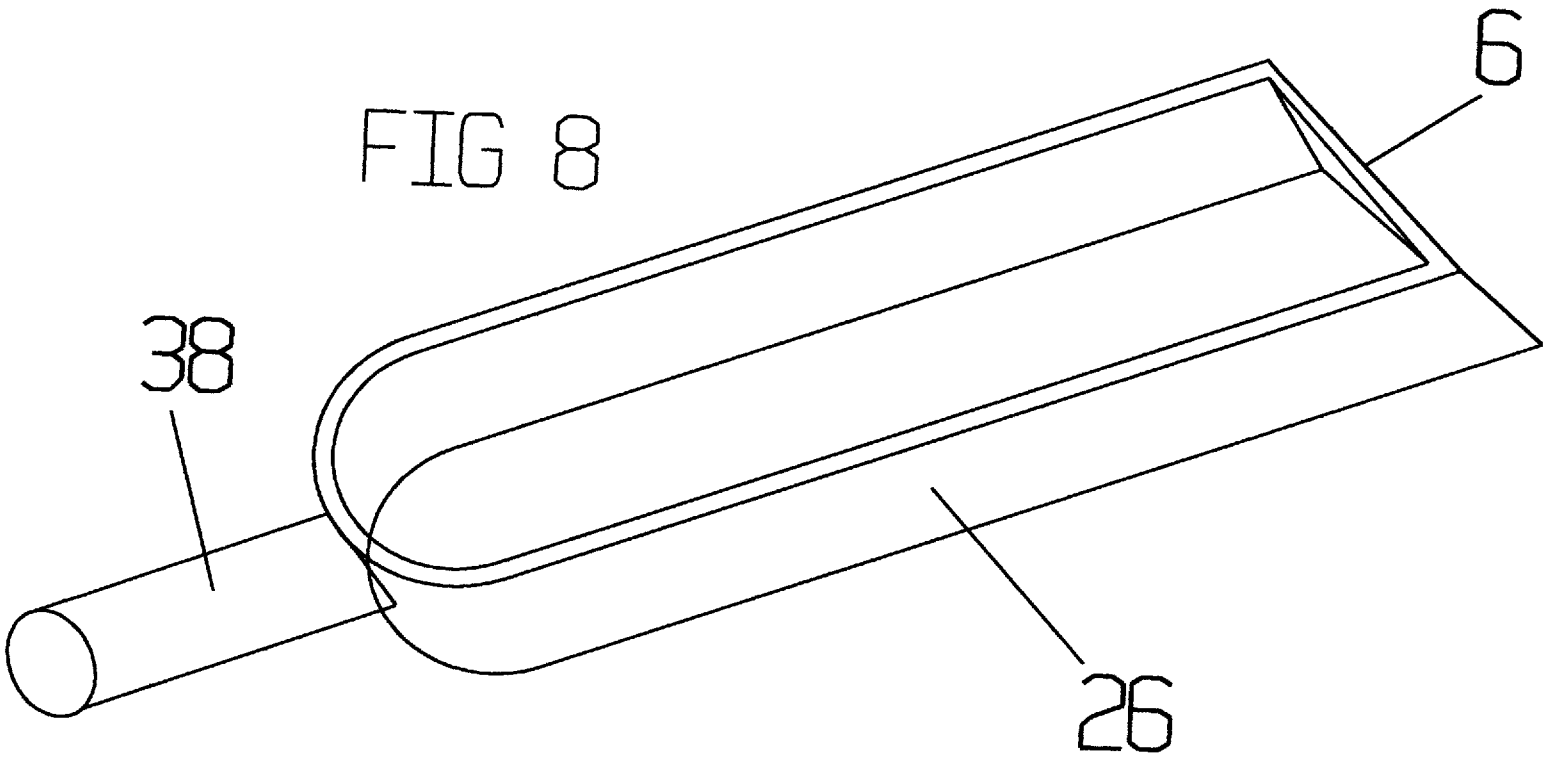
FIG. 8 shows a perspective view of an adjustable trigger actuation stirrup subassembly of the third embodiment.
Figure 9:
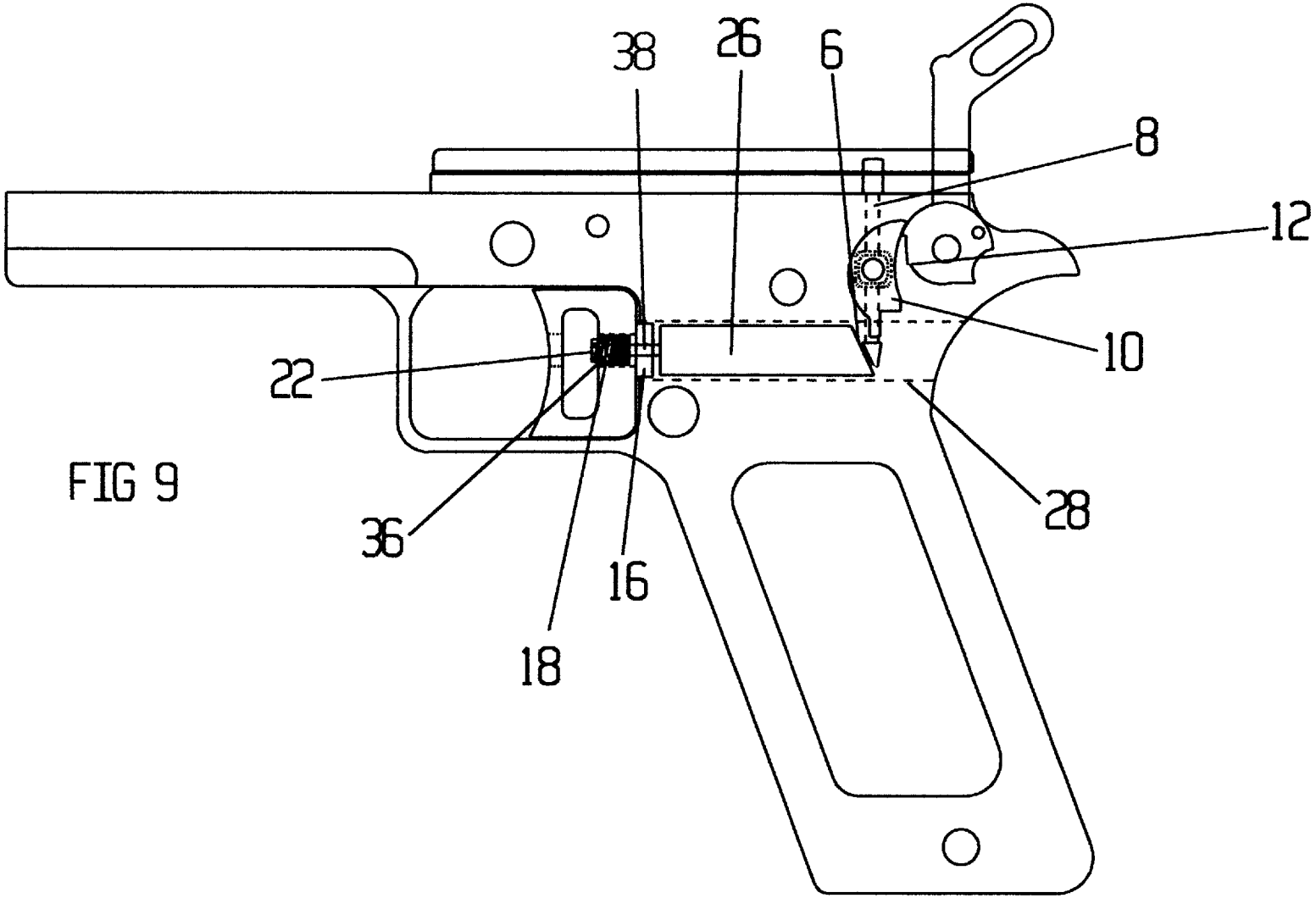
FIG. 9 shows a sectional view of a handgun with the third embodiment installed.

A further embodiment of the externally adjustable trigger assembly for handguns with slide trigger is illustrated in FIG. 7A, FIG. 7B, FIG. 8, and FIG. 9. FIG. 7A shows a perspective view of an adjustable slide trigger subassembly which includes a pair of trigger stop flanges 16, a partially threaded trigger adjusting hole 18, a externally threaded adjusting plug with internal smooth hole 36 and a allen head socket 22. FIG. 7B shows a frontal view of the adjustable slide trigger subassembly to show a better view of trigger stop flanges 16. FIG. 8 shows a perspective view of an adjustable trigger actuation stirrup subassembly which includes a smooth pin 38, a pair of stirrup side rails 26 and a rear surface actuation stirrup 6. Operation of this embodiment of the adjustable slide trigger assembly is as follows. Plug 36 is threaded into hole 18 via the front of the trigger subassembly. Smooth pin 38 is pushed into the internal smooth hole of plug 36 via the back of the trigger subassembly. This adjustable trigger assembly is installed in the handgun in the same manner and in place of the conventional slide trigger as shown in FIG. 9. Trigger stop flanges 16 limit forward trigger travel by fitting within and butting up against the end of a pair of internal stirrup frame rails 28 as shown in FIG. 9. An allen wrench is inserted into allen head socket 22 and turned in a clockwise direction. This causes plug 36 to move toward the rear of the trigger as it travels in hole 18. As plug 36 moves rearward, the smooth pin 38, which is inserted into plug 36, moves rearward. As smooth pin 38 is rigidly affixed to stirrup side rails 26, this rearward motion causes the rear surface actuation stirrup 6 to move closer to and ultimately to begin to engage sear disconnector 8. The rearward motion of rear surface actuation stirrup 6 is limited by partially threaded trigger adjusting hole 18 which plug 36 travels in. Plug 36 will bottom out in hole 18 at a point prior to rear surface actuation stirrup 6 moving sear disconnector 8 to the point where sear 10 is disengaged from hammer full cock notch 12. Trigger slack is eliminated and trigger-pull is the lightest at this point. Trigger slack is reintroduced and trigger-pull increases as plug 36 is rotated in a counterclockwise direction, reaching a maximum trigger-pull when stirrup side rails 26 are brought into contact with trigger stop flanges 16 which rest in internal stirrup frame rails 28. The advantages of this embodiment over conventional slide triggers and the Behlert adjustable trigger are identical to those described in the first embodiment above. Tests of many different slide trigger handguns using the smooth pin approach described in this embodiment and the threaded pin approach described in the first and second embodiments show essentially no difference in trigger slack reduction and in the range of variable trigger-pull adjustment available. Additionally, this smooth pin approach can be used in combination with the side accessible adjusting mechanism described in the second embodiment with the same advantages over the prior art as described in the first embodiment.

From the description above, a number of advantages of the present invention became evident:

(a) it provides a wide range of trigger-pull pressures from conventional slide trigger-pull pressures on the high side to low trigger-pull pressures comparable to that provided in expensive competition pistols.

(b) it provides elimination of slack in trigger-pull, providing clean, crisp trigger-pull characteristics.

(c) no drilling and tapping or other permanent handgun modifications are necessary to install-simply drop in the adjustable trigger in place of the existing slide trigger.

Summary, Ramifications, and Scope

Accordingly, it is seen that the externally adjustable trigger assembly of the present invention can be used to field-adjust trigger-pull easily and conveniently for handguns which previously did not have this capability. Furthermore, the externally adjustable trigger assembly of the present invention has the additional advantages in that no drilling/tapping or other permanent handgun modifications are required to install;

slack in the trigger-pull is eliminated leaving a clean, crisp trigger-pull;

the adjustable trigger is easy to install and adjust;

the handgun owner is readily able to remove the adjustable trigger and re-install the stock trigger if he/she decides to sell the handgun or use the adjustable trigger in another handgun.

Although the descriptions above contain many specificities, these should not be construed as limiting the scope of the invention but as merely providing illustrations of some of the presently preferred embodiments of this invention.

Thus the scope of the inventions should be determined by the appended claims and their legal equivalents rather than by the examples given.

I claim:

1. A firearm trigger mechanism comprising a trigger housing, a trigger slidingly mounted within said trigger housing, said trigger having a means to limit forward travel, said trigger having a hole exiting said trigger, said hole containing a drive means, said drive means engaging a firing mechanism linkage, said firing mechanism linkage having at one end an engagement means for engaging said drive means, said drive means being accessible externally of said trigger housing for effecting movement of said firing mechanism linkage relative to said trigger.

2. The trigger mechanism as recited in claim 1, wherein said means to limit forward travel is a plurality of flanges which extend transversely from the back of said trigger and which abut said trigger housing.

3. The trigger mechanism as recited in claim 1, wherein said engagement means is a threaded member.

4. The trigger mechanism as recited in claim 1, wherein said engagement means is an unthreaded member.

5. A firearm trigger mechanism comprising a trigger housing, a trigger slidingly mounted within said trigger housing, said trigger having a means to limit forward travel, said trigger having a hole exiting said trigger, said hole containing a cylindrical shaped member, said cylindrical shaped member engaging a firing mechanism linkage, said firing mechanism linkage having at one end an engagement means for engaging said cylindrical shaped member, said cylindrical shaped member being accessible externally of said trigger housing for effecting movement of said firing mechanism linkage relative to said trigger.

6. The trigger mechanism as recited in claim 5, wherein said hole exiting said trigger is at least partially threaded.

7. The trigger mechanism as recited in claim 6, wherein said cylindrical shaped member has a threaded exterior at least partially along its length which threadedly engages said hole exiting said trigger.

8. The trigger mechanism as recited in claim 5, wherein said cylindrical shaped member has a threaded interior hole at least partially along its length which threadedly engages said firing mechanism linkage.

9. The trigger mechanism as recited in claim 5, wherein said cylindrical shaped member has a smooth interior hole at least partially along its' length which engages said firing mechanism linkage.

10. The trigger mechanism as recited in claim 5, wherein said cylindrical shaped member has a plurality of bores located transversely to said threaded bore for engagement of a tool to effect rotation of said cylindrical shaped member through the side of said trigger.

11. The trigger mechanism as recited in claim 5, wherein said cylindrical shaped member has an allen head socket located at the outside end of said cylindrical shaped member for engagement of an allen wrench through the front of said trigger to effect rotation of said cylindrical shaped member.

* * * * *